US008888612B2

(12) United States Patent
Hwang et al.

(10) Patent No.: US 8,888,612 B2
(45) Date of Patent: Nov. 18, 2014

(54) GOLF BALL WITH CIRCULAR DIMPLE HAVING THE RADIAL CONCAVE SURFACE CONCENTRICALLY

(75) Inventors: In Hong Hwang, Gyeonggi-do (KR); Kyung Ahn Moon, Seoul (KR)

(73) Assignee: Volvik Inc., Chungcheongbuk-Do (KR)

( * ) Notice: Subject to any disclaimer, the term of this patent is extended or adjusted under 35 U.S.C. 154(b) by 147 days.

(21) Appl. No.: 13/603,691

(22) Filed: Sep. 5, 2012

(65) Prior Publication Data

US 2014/0004977 A1 Jan. 2, 2014

(30) Foreign Application Priority Data

Jul. 2, 2012 (KR) ..... 10-2012-0071848

(51) Int. Cl.
*A63B 37/12* (2006.01)
*A63B 37/14* (2006.01)

(52) U.S. Cl.
USPC ..... 473/383; 473/378; 473/384

(58) Field of Classification Search
USPC ..... 473/378–384
See application file for complete search history.

(56) References Cited

U.S. PATENT DOCUMENTS

| | | | | |
|---|---|---|---|---|
| 5,338,039 | A * | 8/1994 | Oka et al. | 473/384 |
| 5,547,197 | A * | 8/1996 | Pocklington | 473/384 |
| 5,879,245 | A * | 3/1999 | Hwang | 473/384 |
| 5,957,787 | A * | 9/1999 | Hwang | 473/379 |
| 2006/0073915 | A1 * | 4/2006 | Aoyama | 473/378 |
| 2008/0004137 | A1 * | 1/2008 | Kasashima et al. | 473/383 |
| 2009/0131204 | A1 * | 5/2009 | Sullivan | 473/384 |

FOREIGN PATENT DOCUMENTS

| | | |
|---|---|---|
| KR | 10-2000-0007178 | 2/2000 |
| KR | 10-2009-0035130 | 4/2009 |

* cited by examiner

*Primary Examiner* — Gene Kim
*Assistant Examiner* — John E Simms, Jr.
(74) *Attorney, Agent, or Firm* — Harness, Dickey & Pierce, P.L.C.

(57) ABSTRACT

Provided is a golf ball having an improved structure of a plurality of circular dimples formed on a surface of the golf ball to improve flight stability and increase a flying distance. With a golf ball having a plurality of circular dimples on a surface thereof, a plurality of concaves, each of which has a shape of an arc concentric with the circular dimple, are formed at a predetermined interval along a circumference of the entire or a portion of the circular dimple.

6 Claims, 6 Drawing Sheets

GOLF BALL WITH CIRCULAR DIMPLE HAVING THE RADIAL CONCAVE SURFACE CONCENTRICALLY

CROSS-REFERENCE TO RELATED APPLICATION

This application claims the benefit and priority of Korean patent application No. 10-2012-0071848, filed Jul. 2, 2012. The entire disclosure of the above application is incorporated herein by reference.

FIELD

The present disclosure relates to a golf ball. More particularly, the present disclosure relates to a golf ball having an improved structure of a plurality of circular dimples formed on a surface of the golf ball and being capable of improving flight stability and increasing a flying distance.

BACKGROUND

In many types of gold balls, circular dimples are uniformly arranged on a surface thereof. When the golf ball with circular dimples is hit by a golf club, the golf ball shows a high initial speed with high elasticity, and the golf ball has reverse-rotation in the direction opposite to the flying direction, that is, backspin according to a golf club loft angle.

In the flight of the golf ball with backspin, the circular dimples cause a lift force to be generated from pressure difference between the upper and lower sides of the golf ball, so that a staying time is increased, and thus, a flying distance is increased. In addition, with respect to the air flowing along the surface of the golf ball, turbulent flow occurs in the vicinity of the circular dimples, and a departing point of a so-called boundary layer is sent backward, so that a drag coefficient is decreased, and thus, the flying distance is increased.

After the golf ball lofting at a high speed reaches a peak of the trajectory, the golf ball is dropping toward the ground due to gravity. The flight trajectory of the golf ball is mainly divided into a high speed range from the launching position to the peak and a low speed range from the peak to the landing position of the ground.

The flying characteristics of the golf ball in the flight trajectory are determined mainly by an arrangement pattern of the circular dimples and a diameter, shape, and depth of the circular dimple. Among the factors, the difference in the flying distance between the golf balls occurs dominantly due to a volume of the circular dimple which is defined by the diameter and depth of the circular dimple.

In the case of a golf ball with circular dimples having a large diameter, the lift force is easily obtained after the impact, so that the flying height of the golf ball can be rapidly increased. This ball is called a high-trajectory golf ball. However, the high-trajectory golf ball is greatly influenced by wind. When a head wind is blowing in the direction opposite to the flying direction of the golf ball, the flying height of the golf ball is too rapidly increased, so that the flying distance is decreased and the landing position is not uniform (the golf ball has bad directionality).

On the contrary, in the case of a golf ball with circular dimples having a small diameter, the lift force is not easily obtained after the impact, so that the flying height of the golf ball is low and the golf ball is early landed. In other words, the flying distance is small, and the staying time is short. This ball is called a low-trajectory golf ball. However, in comparison with the high-trajectory golf ball, the low-trajectory golf ball is not greatly influenced by wind, so that the directionality is not bad.

In addition, in the case of the circular dimples having a large diameter, the drag coefficient is large in the high speed range, but the drag coefficient is small in the low speed range. On the contrary, in the case of the circular dimples having a small diameter, the drag coefficient is small in the high speed range, but the drag coefficient is large in the low speed range.

On the other hand, as described above, the flying characteristics of the golf ball is also determined by the depth of the circular dimple. The deepest portion of the circular dimple is the central portion of the circular dimple.

Among the circular dimples with the same diameter, the deeper circular dimple has a larger volume, so that the lift force can be easily obtained. However, in the high speed range, the pressure drag is increased, so that the flying distance cannot be easily improved. Particularly, if the circular dimple is too deep, there is a problem in that the golf ball is greatly influenced by wind.

On the contrary, among the circular dimples with the same diameter, the shallower circular dimple has a smaller volume, so that a sufficient lift force cannot be obtained. Therefore, there is a problem in that the flying distance is decreased.

In addition, practically, the depth for the volume of the circular dimple as one of the important factors for the flying characteristics of the golf ball cannot be easily adjusted in production of a mould cavity for manufacturing the golf ball. In addition, several problems occur in the formation of covers of the golf ball. Therefore, there is a practical problem in that the depth of the circular dimple cannot be easily adjusted arbitrarily without consideration of the diameter of the circular dimple.

In addition, in most cases of golf balls with general circular dimples, the volume is in a range of from 350 $mm^3$ to 500 $mm^3$. If the diameter of the circular dimple is increased, the volume is increased; and if the diameter of the circular dimple is decreased, the volume is decreased. Therefore, there is a problem in that large influences cannot be easily induced on the flying characteristics of the golf ball.

On the other hand, for several seconds after the impact applied to the golf ball, the golf ball flies at a high speed due to strong repulsive power, so that the Reynolds number is increased and the drag coefficient becomes low. After the peak where the driving force of the golf ball becomes weak, the drag coefficient is rapidly increased, and the influence of gravity is dominant, so that the golf ball is landed on the ground with a short staying time.

Therefore, in order to increase the total flying distance of the golf ball, it is important to increase the staying time in the low speed range from the peak to the landing position in the trajectory of the golf ball. Particularly, increasing the staying time in the vicinity of the peak is the most important factor of increasing the flying distance.

Accordingly, in order to increase the flying distance in the low speed range, it is preferable that the diameter of the circular dimple be large. However, as described above, if the diameter of the circular dimple is increased, the golf ball is too greatly influenced by wind, so that the directionality of the golf ball becomes bad. Therefore, the golf ball cannot be landed at the position which is desired by a golfer, but it is landed on an unexpected position. In other words, the golf ball becomes a golf ball having bad controllability.

Recently, in order to overcome these problems, a medium-trajectory golf ball has been used, where an appropriate combination of the circular dimples having a large diameter and having a small diameter is used, so that the directionality and the flying distance are somewhat improved. However, there is a problem in that satisfactory effects cannot be obtained with respect to the directionality and the flying distance.

Korean Patent Laid-Open Publication No. 10-2000-0007178 (published on Feb. 7, 2000) describes a golf ball having dimples arranged by separating the surface of a sphere into a sphere shaped polyhedron for maintaining balance of a resistance.

Korean Patent Laid-Open Publication No. 10-2009-0035130 (published on Apr. 9, 2009) describes a dimple internal structure of a golf ball comprising a plurality of dimples of a concave type formed in a peripheral part of the golf ball and a protrusion portion or a groove portion selectively formed in the lateral part of the whole or partial dimple.

SUMMARY

The present disclosure is to provide a golf ball capable of improving flight stability and increasing a flying distance.

According to an aspect of the present disclosure, there is provided a golf ball having a plurality of circular dimples on a surface thereof, wherein a plurality of concaves, each of which has a shape of an arc concentric with the circular dimple, are formed at a predetermined interval along a circumference of the circular dimple.

In the above aspect, the circular dimples with the circumferential concaves which are close to great circles G dividing the surface of the golf ball into faces of a spherical polygon may be arranged so that outer circles of rings of circumferential concaves having an outer diameter D1 are close to an upper concave limit line U and inner circles of rings of circumferential concaves having an inner diameter D2 are close to a lower concave limit line R, wherein the upper and lower concave limit lines U and R are virtual lines separated by predetermined intervals from the great circle.

In another embodiment, when an interval between the upper concave limit line U and the great circle G is defined by "a" and an interval between the lower concave limit line R and the great circle G is defined by "b", the following conditions may be satisfied.

$$0.15\ \text{mm} < a < 1.5\ \text{mm}$$

$$0.15\ \text{mm} < b < 1.5\ \text{mm}$$

In yet another embodiment, a depth H1 of the circumferential concave may be formed so as to be in a range of from 50% to 100% of a depth H2 of the central portion of the circular dimple. More specifically, the depth H1 of the circumferential concave may be in a range of 0.1 mm<H1<0.18 mm, and the depth H2 of the central portion of the circular dimple may be in a range of 0.12 mm<H2<0.2 mm.

In yet another embodiment, the four or five circumferential concaves may be disposed at a predetermined interval, and an angle θ occupied by the circumferential concave about the center C of the circular dimple corresponding to a length of the circumferential concave may be in a range of from from 30° to 60°.

In yet another embodiment, an outer diameter D1 of a ring of the circumferential concaves may be in a range of from 2.5 to 5.5 mm, and an inner diameter D2 of the ring of circumferential concaves may be in a range of from 2.2 to 5.2 mm.

With a golf ball according to the present disclosure where circular dimples with circumferential concaves are symmetrically arranged on a surface of a spherical body, flight stability is maintained, and a staying time after a peak of a trajectory is increased in a low speed range, so that a flying distance can be greatly increased in comparison with a golf ball where general circular dimples are arranged.

DETAILED DESCRIPTION

In the present disclosure, as a substitute for existing circular dimples, new concept circular dimples are arranged on a surface of a golf ball. More specifically, a plurality of concaves, each of which has a shape of an arc concentric with the circular dimple, are formed at a predetermined interval along a circumference of the entire or a portion of the circular dimples, and the circular dimples are symmetrically arranged on the entire surface of a spherical body, that is, the golf ball, so that flight stability can be maintained and flying distance can be increased.

Hereinafter, a golf ball according to an embodiment of the present disclosure will be described in detail with reference to the attached drawings.

Figure 1:
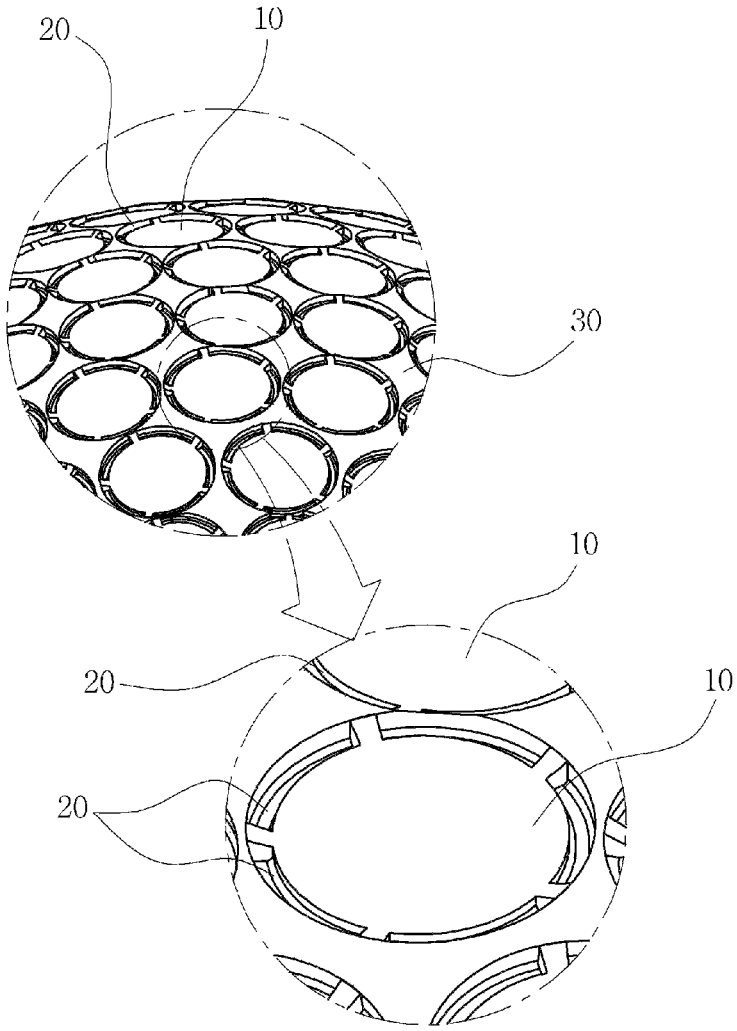
FIG. 1 illustrates a partial perspective view of a golf ball according to an embodiment of the present disclosure where circular dimples with circumferential concaves are arranged on a surface thereof and an enlarged partial perspective view thereof.
Figure 2:
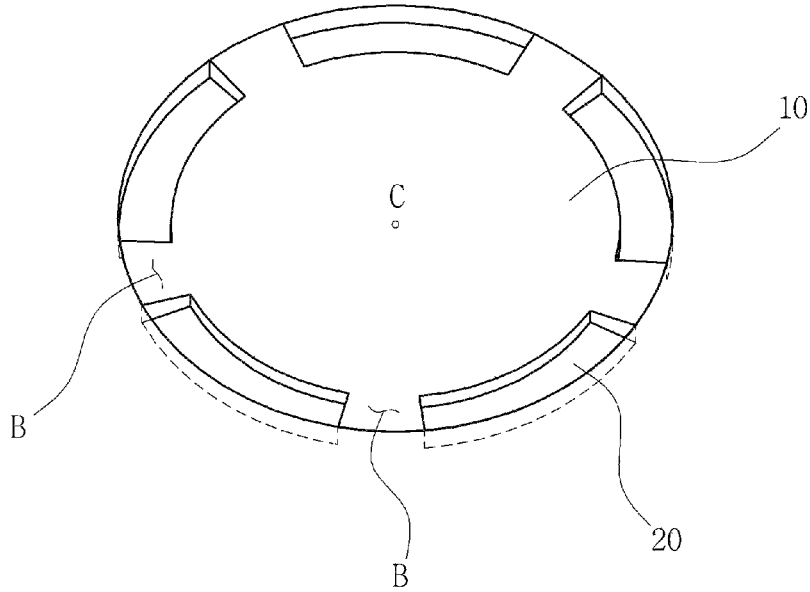
FIG. 2 is a perspective view illustrating a unit circular dimple with circumferential concaves according to the embodiment of the present disclosure.
Figure 3:
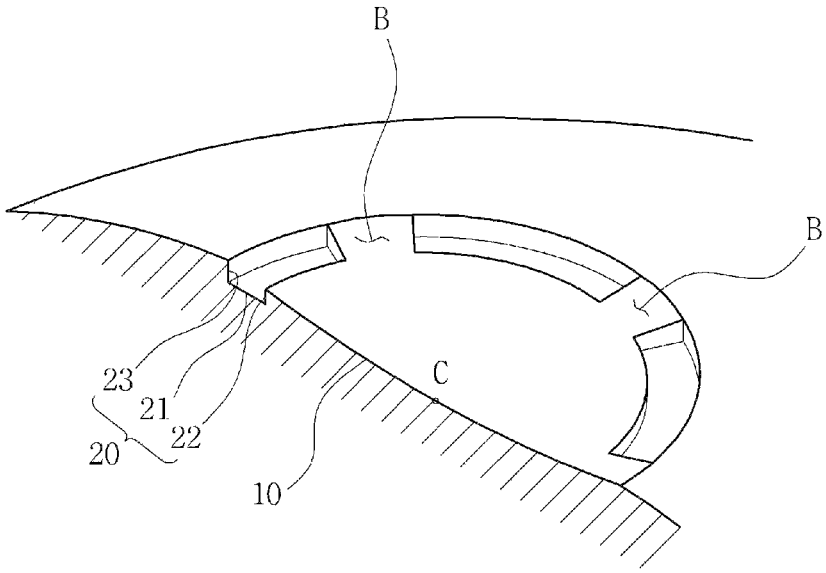
FIG. 3 is a partially cutaway view illustrating a circular dimple with circumferential concaves according to the embodiment of the present disclosure.

FIG. 1 illustrates a partial perspective view of a golf ball according to an embodiment of the present disclosure where circular dimples with circumferential concaves are arranged on a surface thereof and an enlarged partial perspective view thereof. FIGS. 2 and 3 are a perspective view and a partially cutaway view illustrating a unit circular dimple with circumferential concaves according to the embodiment of the present disclosure, respectively.

Figure 4:
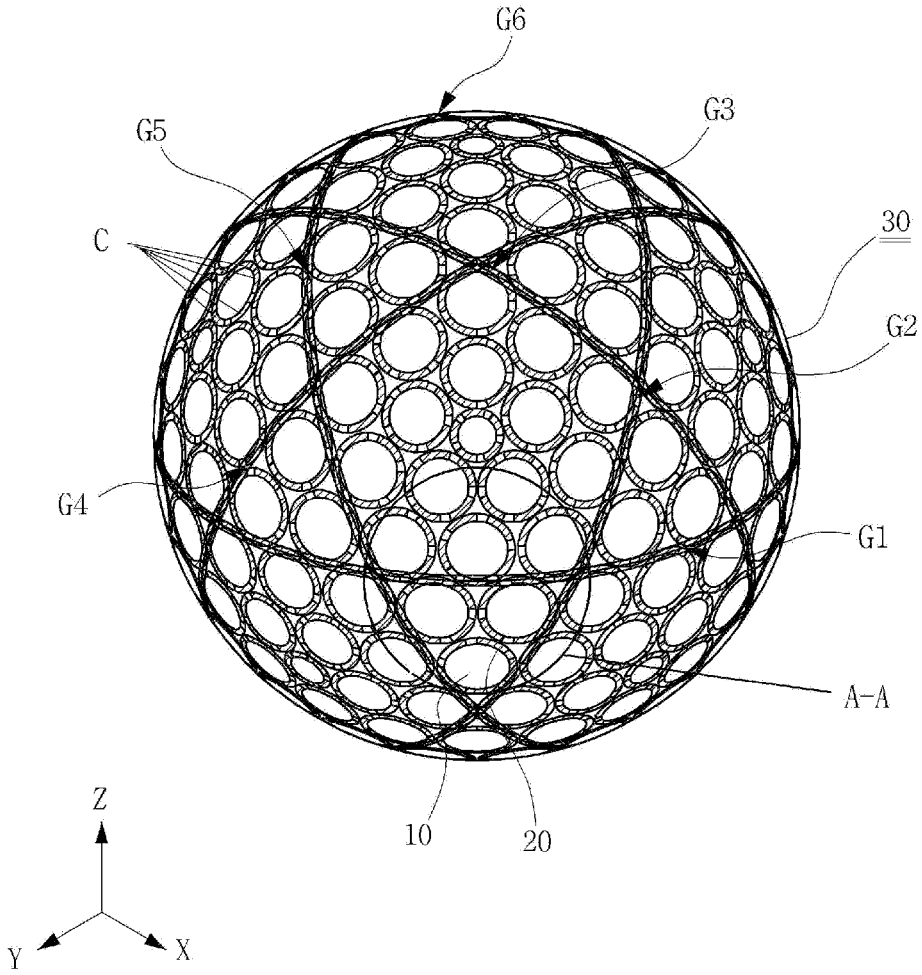
FIG. 4 is a schematic view illustrating a golf ball according to the embodiment of the present disclosure where circular dimples with circumferential concaves are arranged on a surface thereof.

Referring to FIGS. 1 and 2, the circumferential concaves 20 with a concavely recessed structure are formed along a circumference of the circular dimple 10 of a spherical body 30, of which the upper portion has an open configuration as the golf ball is viewed in the vertical direction downwards from the upper side of the golf ball (Z axis direction in FIG. 4). The circumferential concave 20 is formed along the circumference of the circular dimple 10 in a shape of an arc which is concentric with the circular dimple 10 with respect to the center C of the circular dimple 10.

The structure of the circumferential concave 20 will be described in detail with reference to FIG. 3. The circumferential concave 20 is configured with a bottom surface 21 as a bottom of the circumferential concave 20, an inner wall 22 as a wall of the circumferential concave 20 which is formed at the center side of the circular dimple 10, and an outer wall 23 as the other wall of the circumferential concave 20 which is formed along the circumference side of the circular dimple 10. The bottom surface 21 is formed to be flat, and the inner and outer walls 22 and 23 are vertically formed to face each other with a predetermined interval.

The bottom surface 21 of the circumferential concave 20 is formed to be deeper than the center C of the circular dimple 10. The relationship between the depth of the circumferential concave 20 and the depth of the circular dimple 10 is one of the important factors influencing flight characteristics of the golf ball, which is described later in detail.

The circumferential concave 20 may be formed along the entire circumference of the circular dimple 10. However, in this case, during the flight of the golf ball, a large drag force due to vacuum occurs behind the golf ball. As a result, the directionality becomes bad, and the flying distance is decreased.

Therefore, it is preferable that a plurality of the circumferential concaves 20 be formed at a predetermined interval along the circumference of the circular dimple 10. The length of the unit circumferential concave 20, that is, the angle occupied by one circumferential concave 20 about the center C of the circular dimple 10 is also one of the important factors influencing the flight characteristics of the golf ball, which is described later in detail.

In the case where a plurality of the circumferential concaves 20 are formed along the circumference of the circular dimple 10 at a predetermined interval, the portions B where the circumferential concaves 20 are not formed between the circumferential concaves 20 constitute the inner surface of the circular dimple 10 which rises and extends from the center C of the circular dimple 10 to the circumference thereof with a predetermined curvature.

As illustrated in FIG. 3, the inner wall 22 of the circumferential concave 20 which is formed at the center side of the circular dimple 10 is formed to be lower than the outer wall 23 thereof, and the inner surface of the circular dimple 10 extending from the center C of the circular dimple 10 to the circumference and the inner surface of the circular dimple 10 extending to the inner wall 23 of the circumferential concave 20 are formed to have the same curvature, so that the entire inner surface of the circular dimple 10 is formed to be smoothly curved with the same curvature.

In this manner, according to the present disclosure, the circumferential concaves 20 are formed along the circumferences of the circular dimples 10, and the circumferential concave 20 is formed to be deeper than the portions except for the center C of the circular dimple 10, so that the volume of the circumference portions of the circular dimples 10 is increased without increase in depth and diameter of the circular dimple 10. Therefore, the staying time of the golf ball can be further increased at the flying correction portion, and the flying time can be increased with small influence of wind in the low speed range.

FIG. 4 is a schematic view illustrating the golf ball where the circular dimples with the circumferential concaves are arranged on a surface thereof.

According to the present disclosure, similarly to an arrangement pattern of general circular dimples in a golf ball, the circular dimples 10 with the circumferential concaves 20 are arranged with a left/right symmetry on faces of a spherical polygon, which are formed by dividing the surface of the spherical body 30, so that uniform flying characteristics can be obtained over the entire surface of the golf ball. The same purpose can be achieved by any arrangement pattern of the circular dimples which are arranged with a left/right symmetry without the division of the spherical polygon. However, according to the present disclosure, it is preferable that the circular dimples be arranged on the divided faces of the spherical polygon in terms of convenience of the left/right symmetry of the golf ball and stability and uniformity of the flying characteristics.

Referring to FIG. 4, a spherical icosidodecahedron is used as the spherical polygon. The circular dimples 10 with the circumferential concaves 20 arranged on faces obtained by dividing the surface of the spherical body 20 by six great circles G1, G2, G3, G4, G5, and G6 in a well-known method. Herein, any one of the six great circles G1, G2, G3, G4, G5, and G6 may serve as an equator line of the spherical body, that is, a mould connection line.

Hereinbefore, the arrangement pattern of the circular dimples with the circumferential concaves 20 according to the present disclosure is described by exemplifying a spherical icosidodecahedron. The present invention is not limited thereto, and a spherical tetrahedron, a spherical hexahedron, a spherical octahedron, a spherical dodecahedron, a spherical icosahedron, a spherical hexa-octahedron, a spherical icosidodecahedron, or the like may be used.

On the other hand, it should be noted that the circular dimples 10 with the circumferential concaves 20 are symmetrically arranged in a spherical polygon. This feature is taken for the following reasons. The circumferential concave 20 is deeper than the portions other than the central portion of the circular dimple 10, so that the volume of the circumferential concave 20 is larger than the volumes of the other portions of the circular dimple 10. Since the golf ball is greatly influenced by air flow during the flight, if the circumferential concaves are evenly and uniformly disposed at certain positions, the flight stability becomes good, and the directionality becomes good.

Therefore, it is preferable that the positions of the circumferential concaves are limited with reference to the great circles forming the spherical polygon.

According to the present disclosure, the positions of the circumferential concaves 20 of the circular dimples 10 are limited so as to be within virtual lines which are separated by certain intervals from the great circles G.

Figure 5:
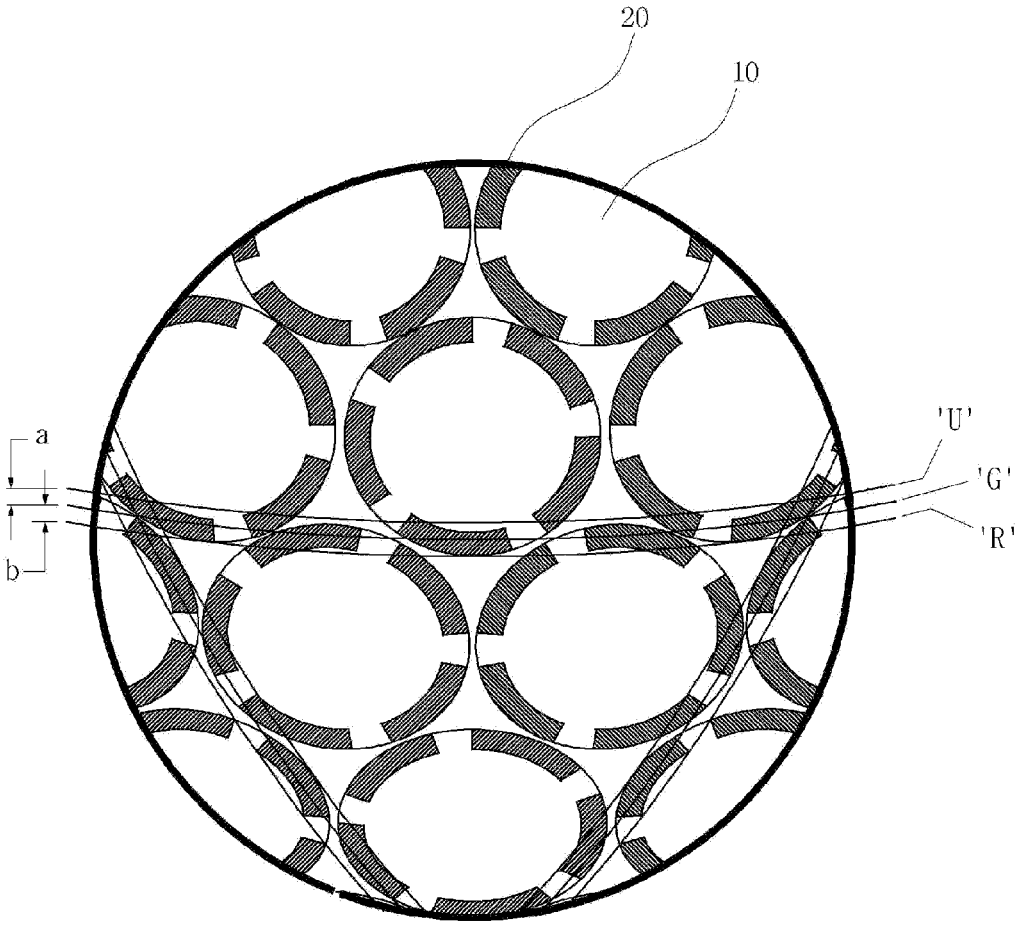
FIG. 5 is a detailed view illustrating an area A-A illustrated in FIG. 4, where limit of a size which can be occupied by a circumferential concave is illustrated by separation magnitudes of upper and lower concave limit lines separated from a great circle as a reference.
Figure 6:
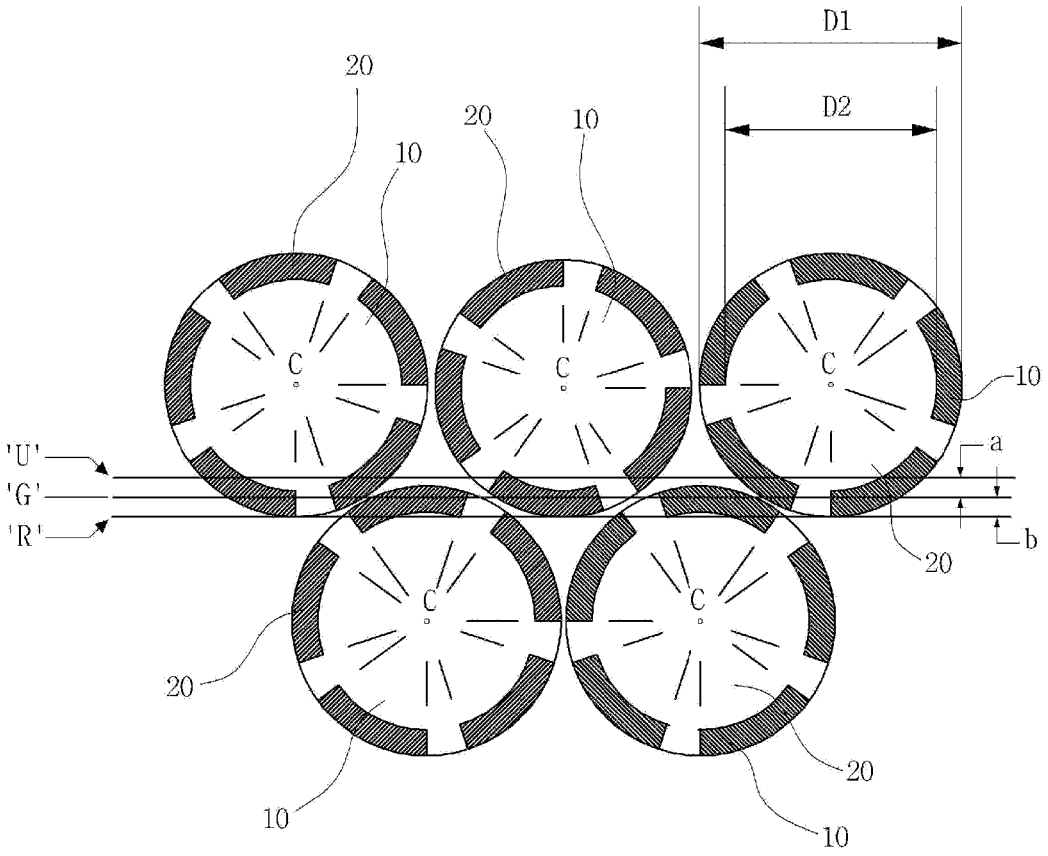
FIG. 6 is a plan view illustrating a state where circular dimples with circumferential concaves are arranged along the upper and lower concave limit lines in upper and lower portions with respect to the great circle illustrated in FIG. 5.

FIG. 5 is a detailed view illustrating an area A-A illustrated in FIG. 4, where the limit of the size which can be occupied by the circumferential concave 20 is illustrated by separation magnitudes of upper and lower concave limit lines separated by certain intervals from the great circle G as a reference. FIG. 6 is a plan view illustrating a state where the circular dimples 10 with the circumferential concaves 20 are arranged along the upper and lower concave limit lines U and R in upper and lower portions with respect to the great circle G illustrated in FIG. 5.

Referring to FIGS. 5 and 6, the virtual lines within which the positions of the circumferential concaves 20 of the the circular dimples 10 are limited at a predetermined interval are formed in the upper and lower portions with respect to the great circle G. The one line is close to circles, each of which connects the outer walls of the circumferential concaves 20, that is, the outer circles of the rings of circumferential concaves which have an outer diameter D1; and the other line is close to circles, each of which connects the inner walls of the circumferential concaves 20, that is, the inner circles of the rings of circumferential concaves which have an inner diameter D2.

The functions of the upper and lower concave limit lines may be switched therebetween. In the upper and lower concave limit lines U and R, the terms "upper" and "lower" are selected for the convenience of description. In addition, as described above, similarly to the great circles G, the upper and lower lines U and R are virtual lines which cannot be seen in an actual golf ball.

In this manner, due to the virtual upper and lower concave limit lines U and R, the circular dimples 10 with the circumferential concaves 20 can be arranged with a certain rule within faces of the spherical polygon, which are formed by dividing the surface of the golf ball with six great circles G. Therefore, in the golf ball, the circular dimples 10 can be symmetrically arranged at certain positions. According to the present disclosure, due to the the circular dimples 10 with the circumferential concaves 20, the air flow can be induced uniformly in any portions of the entire surface of the golf ball, so that it is possible to obtain good directionality.

In addition, the size occupied by the circumferential concave 20 is one of the important factors influencing the flying performance of the golf ball according to the present disclosure. The size occupied by the circumferential concave 20 is defined by using an interval "a" between the upper limit line U and the great circle G and an interval "b" between the lower concave limit line R and the great circle G.

It is preferable that the interval "a" between the upper concave limit line U and the great circle G be in a range of from 0.15 mm to 1.5 mm and the interval "b" between the lower concave limit line R and the great circle G be in a range of from 0.15 mm to 1.5 mm.

If each of the intervals "a" and "b" is smaller than 0.15 mm, the air flow is not influenced, so that the flying characteristics are not different from those of a golf ball having general circular dimples. If each of the intervals "a" and "b" is larger than 1.5 mm, an excessive lift force is generated, so that the trajectory is greatly heightened. Therefore, the golf ball is greatly influenced by wind, so that the golf ball has bad directionality.

In addition, the actual size of the circumferential concave 20 associated with the upper and lower concave limit lines U and R, that is, the size of the circumferential concave 20 which is defined by the outer and inner diameters D1 and D2 of the ring of circumferential concaves is one of the important factors influencing the flying performance of the golf ball according to the present disclosure.

It is preferable that the outer diameter D1 of the ring of circumferential concaves 20 be equal to the diameter of the circular dimple 10 without exceeding the diameter of the circular dimple 10. In the present disclosure, it is preferable that the outer diameter D1 of the ring of circumferential concaves 20 be in a range of from 2.5 mm to 5.5 mm.

If the outer diameter D1 is smaller than 2.5 mm, the size of the circumferential concave 20 also becomes too small. Therefore, the staying time in a low speed range cannot be increased, so that the flying distance of the golf ball cannot be increased. If the outer diameter D1 is larger than 5.5 mm, the size of the circular dimple 10 also becomes large. Therefore, excessive pressure drag is exerted on the golf ball in a high speed range, so that the flying distance is decreased. In addition, the golf ball is greatly influenced by wind, so that the golf ball has bad directionality.

The interval between the outer and inner diameters D1 and D2 of the ring of circumferential concaves, that is, the width of the circumferential concave is associated with the upper and lower concave limit lines U and R and is in a range of from $0.15\ \text{mm} < W < 1.5\ \text{mm}$.

As described above, if the width W of the circumferential concave 20 is smaller than 0.15 mm, the air flow is not influenced and the staying time in a low speed range cannot be increased, so that the flying characteristics are not different from those of a golf ball having general circular dimples 10. If the width W of the circumferential concave 20 is larger than 1.5 mm, an excessive lift force is generated, so that the trajectory is greatly heightened. Therefore, the flying distance may be decreased. In addition, the golf ball is greatly influenced by wind, and thus, the golf ball land in an unexpected position, so that the golf ball may have bad directionality.

The inner diameter D2 of the ring of circumferential concaves is defined by using the outer diameter D1 of the ring of circumferential concaves and the width of the circumferential concave 20 so as to be in a range of from 2.2 mm to 5.2 mm.

Hereinbefore, as important factors influencing the flying performance of the golf ball according to the present disclosure, the size occupied by the circumferential concave 20 associated with the upper and lower concave limit lines U and R defined with respect to the great circles G of the spherical body 30 constituting the golf ball and the actual size of the circumferential concave 20 are described. In addition, a length and depth of the circumferential concave 20 in the circumferential direction of the circular dimple 10 are also the important factors influencing the flying performance of the golf ball.

Figure 7:
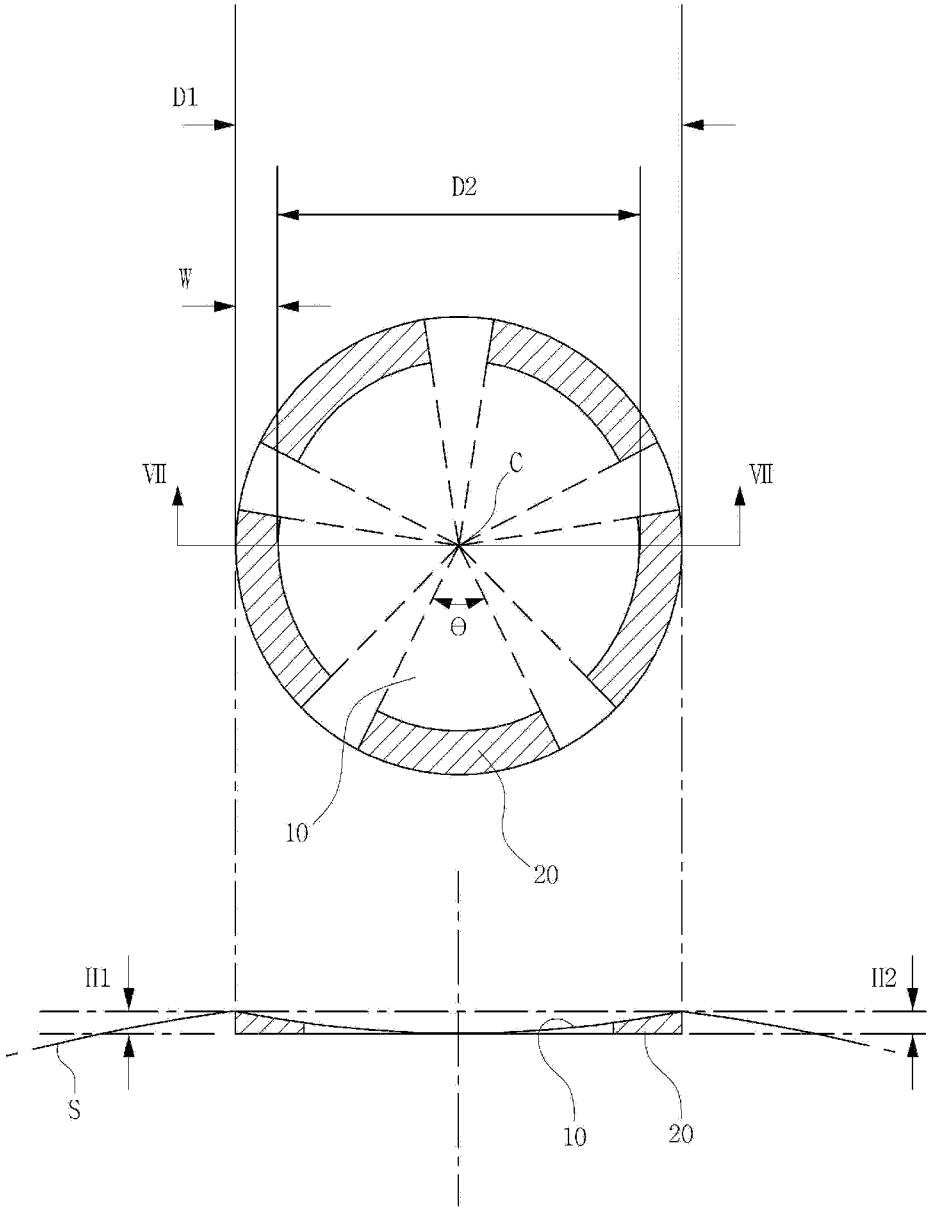
FIG. 7 illustrates a plan view of a circular dimple with circumferential concaves according to the embodiment of the present disclosure, of which a length and depth are illustrated, and a cross-sectional view of the circular dimple with circumferential concaves taken along line VII-VII of the plan view.

FIG. 7 illustrates a plan view of the circular dimple with the circumferential concaves, of which a length and depth in the circumferential direction are illustrated, and a cross-sectional view of the circular dimple with circumferential concaves taken along line VII-VII of the plan view.

As described above, the circumferential concave 20 having a shape of an arc which is concentric with the circular dimple 10 is formed along the circumference of the circular dimple 10. The circumferential concave 20 has a length in the circumferential direction, that is, an angle θ which is occupied by the circumferential concave 20 about the center C of the circular dimple 10.

In the case where the angle θ which occupied by the circumferential concave 20 becomes 360°, namely, in the case where the circumferential concave 20 is formed along the entire circumference of the circular dimple 10, a large drag force occurs behind the golf ball due to vacuum generated during the flight of the golf ball with backspin, so that the directionality of the golf ball becomes bad and the flying distance is decreased.

Therefore, the vacuum region needs to be distributed by allowing the high pressure generated in the circular dimple 10 to be distributed to low pressure areas by forming the circumferential concaves 20. Accordingly, the pressure drag becomes small in a high speed range, and a turbulent flow is rapidly sent backward in a low speed range, so that a critical Reynolds number is decreased. Therefore, the pressure drag is decreased, so that the flying distance can be increased.

The configuration where a plurality of the circumferential concaves 20 are formed at a predetermined interval along the circumference of the circular dimple 10 is more preferable than the configuration where one circumferential concave 20 is formed along the entire circumference of the circular dimple 10.

However, in the case where the number of circumferential concaves 20 is too large, it is almost impossible to produce the mold cavity; and in the case where the number of circumferential concaves 20 is too small, since each of the circumferential concaves is too long, it is difficult to remove the drag force due to vacuum generated during the flight of the golf ball.

Referring to FIG. 7, it is preferable that the number of circumferential concaves 20 arranged in one circular dimple 10 be four through six, and it is preferable that the angle θ occupied by the circumferential concave 20 about the center C of the circular dimple 10 be in a range of from 30° to 60°.

If the angle θ of the circumferential concave 20 is smaller than 30°, the circumferential concave is small, so that the object of the present invention cannot be obtained. If the angle θ of the circumferential concave 20 is larger than 60°, the aforementioned problem of the drag force due to vacuum may occur.

On the other hand, in the present disclosure, the depth H1 of the circumferential concave 20 is also one of the important factors influencing the flying performance of the golf ball. Unlike a general golf ball where the center of the circular dimple is the deepest position, in the circular dimple of the present disclosure, the deep positions may also exist in the circumference portion of the circular dimple 10 as well as the central portion of the circular dimple 10. Due to the difference from the general golf ball, according to the circular dimples 10 with the circumferential concaves 20, the staying time in a low speed range is increased, and during the flight of the golf ball with backspin, the golf ball is not deviated by wind, so that straightforwardness can be obtained.

Referring to FIG. 7, the relationship between the depth H1 of the circumferential concave 20 and the depth H2 of the central portion of the circular dimple 10 will be described in comparison with the general circular dimple as follows.

With respect to the depth H1 of the circumferential concave and the depth H2 of the central portion of the circular dimple 10, in the case where the depth H1 of the circumferential concave is larger than the depth H2 of the central portion of the circular dimple, in a high speed range which is from the launching position to the peak position in the trajectory, an excessive lift force is generated, so that the trajectory is greatly heightened. Therefore, the flying distance is decreased, and the golf ball is greatly influenced by wind.

Therefore, it is preferable that the depth H1 of the circumferential concave 20 be in a range of from 50% to 100% of the depth H2 of the central portion of the circular dimple 10. Particularly, it is more preferable that the depth H1 of the circumferential concave 20 be slightly smaller than the depth H2 of the central portion of the circular dimple 10, that is, the depth H1 of the circumferential concave 20 be 90% of the depth H1 of the circumferential concave 20. Therefore, the depth of the circumferential concave 20 and the volume of the circular dimple 10 are effectively limited, so that it is possible to appropriately increase the volume of the circular dimple while reducing the influence of wind and it is possible to increase the flying time in the low speed range.

Now, the numerical relationship between the depth H1 of the circumferential concave 20 and the depth H2 of the central portion of the circular dimple 10 is described. The depth H1 of the circumferential concave 20 is preferably in a range of 0.1 mm<H1<0.18 mm, and the depth H2 of the central portion of the circular dimple 10 is preferably in a range of 0.12 mm<H2<0.2 mm.

If the depth H1 of the circumferential concave 20 is equal to or smaller than 0.1 mm, the staying time in the low speed range cannot be increased. If the depth H1 is equal to or larger than 0.18 mm, the excessive lift force is generated during the flight, and the too high trajectory is formed, so that flying distance is decreased. In addition, it is difficult to produce a mould, and several problems occur in the formation process at the actual manufacturing site.

In FIG. 7, the reference numeral "S" denotes a virtual circumference of a spherical body constituting an outer appearance of a golf ball.

While the present disclosure has been particularly shown and described with reference to exemplary embodiments thereof, it will be understood by those skilled in the art that various changes in form and details may be made therein without departing from the spirit and scope of the present invention as defined by the appended claims.

What is claimed is:

1. A golf ball having a plurality of circular dimples on a surface therof, wherein a plurality of concaves is formed at a predetermined interval along a circumference of at least one of the circular dimples, wherein each of the concaves has a shape of an arc which is concentric with each circular dimple, wherein each of the concaves has an inner vertical wall formed at the center side of each circular dimple, an outer vertical wall formed along the circumference side of each circular dimple, and a flat bottom surface, and wherein the inner vertical wall, the outer vertical wall, and each circular dimple have the same curvature.

2. The golf ball according to claim 1, wherein a depth H1 of the circumferential concave is formed so as to be in a range of from 50% to 100% of a depth H2 of the central portion of the circular dimple.

3. The golf ball according to claim 2, wherein the depth H1 of the circumferential concave is in a range of from 0.1 to 0.18 mm, and the depth H2 of the central portion of the circular dimple is in a range of from 0.12 to 0.2 mm.

4. The golf ball according to claim 1, wherein an angle θoccupied by the circumferential concave about the center C of the circular dimple corresponding to a length of the circumferential concave is in a range of from 30° to 60°.

5. The golf ball according to claim 1, wherein four or five circumferential concaves are formed at a predetermined interval.

6. The golf ball according to claim 1, wherein an outer diameter D1 of a ring of the circumferential concaves is in a range of from 2.5 to 5.5 mm, and an inner diameter D2 of the ring of circumferential concaves is in a range of from 2.2 to 5.2 mm.

* * * * *